US006060635A

United States Patent [19]

Rosenberg

[11] Patent Number: 6,060,635

[45] Date of Patent: May 9, 2000

[54] METHOD FOR TREATING HAZARDOUS WASTE

[75] Inventor: Rolf Rosenberg, Espoo, Finland

[73] Assignee: Valtion Teknillinen Tutkimuskeskus, Espoo, Finland

[21] Appl. No.: 09/101,363

[22] PCT Filed: Jan. 23, 1997

[86] PCT No.: PCT/FI97/00033

§ 371 Date: Jul. 7, 1998

§ 102(e) Date: Jul. 7, 1998

[87] PCT Pub. No.: WO97/27597

PCT Pub. Date: Jul. 31, 1997

[30] Foreign Application Priority Data

Jan. 23, 1996 [FI] Finland ..... 960317

[51] Int. Cl.[7] ..... G21F 9/00; G21F 9/28; G21F 9/30; G21F 9/32; G21F 9/34

[52] U.S. Cl. ..... 588/1; 588/2; 588/15; 588/18; 588/19; 588/20; 588/205; 588/227

[58] Field of Search ..... 588/15, 18, 19, 588/20, 227, 1, 2, 205; 219/121.38, 121.11, 121.36, 121.37; 315/111.21, 111.01; 423/DIG. 10; 210/682, 600, 660, 681; 376/189, 201, 195, 198, 156, 158, 185, 190, 194, 196

[56] References Cited

U.S. PATENT DOCUMENTS

| | | | |
|---|---|---|---|
| 3,948,601 | 4/1976 | Fraser et al. | 21/54 R |
| 4,909,164 | 3/1990 | Shohet et al. | 110/346 |
| 5,028,452 | 7/1991 | Beatty | 427/41 |
| 5,134,946 | 8/1992 | Poovey | 110/346 |
| 5,545,803 | 8/1996 | Heath et al. | 588/253 |
| 5,882,581 | 11/1995 | Gotovchiikov et al. | 266/241 |

FOREIGN PATENT DOCUMENTS

| | | |
|---|---|---|
| 41 13 440 | 10/1992 | Germany . |
| 43 36 768 | 6/1994 | Germany . |
| 44 28 418 | 2/1996 | Germany . |
| 59-46899 | 5/1984 | Japan . |
| WO 89/10162 | 11/1989 | WIPO . |

OTHER PUBLICATIONS

Taylor, Overview of Thermal Plasma Technology, "Proc. Conf. Electron Beam Melting Refin.", pp. 40–54, 1996.

Peters et al., Treatment Alternatives for Greater–Than–Class C Low Level Waste, 8p, 1990.

*Primary Examiner*—Steven P. Griffin
*Assistant Examiner*—Eileen E. Nave
*Attorney, Agent, or Firm*—Altera Law Group, LLC

[57] ABSTRACT

Procedure for the treatment of radioactive hazardous waste, in which procedure oxygen is treated with radio-frequency electromagnetic radiation in a manner known in itself so that the oxygen forms a cold plasma, and the waste and the oxygen are fed together.

4 Claims, No Drawings

METHOD FOR TREATING HAZARDOUS WASTE

This application is a 371 of international application PCT/FI97/00033 filed Jan. 23, 1997.

The present invention relates to a procedure for the treatment of hazardous waste.

Today, hazardous waste is treated in special hazardous waste disposal plants, where hazardous waste is treated in the first place by burning it in high temperatures and effectively so that the gaseous emissions produced can be admitted into the atmosphere and solid emissions can be recycled or removed to dumping places.

However, treatment of hazardous waste at high temperatures is not always an economic solution, and hazardous waste disposal pi-ants have to use fossil fuels to reach sufficiently high temperatures. Further, there are types of hazardous waste, such as radioactive waste, whose disposal by burning is out of the question because of the atmospheric emissions released via combustion.

Specifications U.S. Pat. No. 5,028,452, WO 89/10162, DE 4113440, DE 4336768 and DE 4428418 present procedures for the treatment of hazardous waste with a cold plasma formed by oxygen.

Prior-art methods for waste treatment are generally not applicable for the treatment of radioactive hazardous waste. In the treatment of radioactive hazardous waste, it is important that no emissions should be admitted into the atmosphere or waste water. In some way or another, all radioactive waste has to be finally so stored that no emissions are released into the environment. At present, e.g. in connection with the treatment of the waste water of nuclear power stations using ion-exchange resin, low-activity waste is generated which cannot be burned as such expressly because of the radioactive emissions released during combustion. For final storage of the radioactive waste contained in the resin, the resin has been subjected to a bacterial treatment and the bacterial mass obtained has been mixed in concrete mass for final storage. However, there are difficulties and problems in bacterial treatment of resin and final storage of the mass obtained.

The object of the present invention is to produce a new method for treating radioactive hazardous waste in such a way that hazardous waste can also be treated in lower temperatures and without releasing harmful emissions into the atmosphere.

As for the features characteristic of the invention, reference is made to the claims.

The invention is based on the basic idea, developed in the investigations which have been carried out, of converting oxygen into the form of a cold plasma and feeding the oxygen and waste together. Since oxygen in the form of a cold plasma is very reactive, hazardous waste can easily be oxidized into a harmless form using such oxygen plasma.

Oxygen can be converted into the form of a cold plasma by subjecting it to radio-frequency electromagnetic radiation, preferably with a frequency of 2–14 MHz. If desirable, hazardous waste can also be treated with such electromagnetic radiation.

The treatment of waste with oxygen in the form of a plasma is preferably carried out at a temperature of 60–150° C. If desired, it Is also possible to use temperatures lower or higher than this.

The treatment of hazardous waste with oxygen in the form of a plasma can be carried out in a desired pressure, a negative or a positive pressure. In a preferred embodiment of the invention, the treatment is performed in negative pressure conditions.

The invention is also applicable for the treatment of radioactive waste, e.g. low-activity waste. Low-activity waste is produced e.g. in treatment of the cooling water of nuclear power stations with ion-exchange resin, which is used to remove radioactive substances from the waste water, i.e. to bind them with the resin. Low-activity ion-exchange resin cannon be burned as such because of the radioactive emissions released during combustion. Therefore, the main approach regarding the treatment of such resin has been to place it in final storage. For this purpose, the resin has been fed to bacteria and the bacterial mass obtained has been mixed in concrete mass or final storage. However, the bacterial treatment of resin and final storage of the mass obtained involve certain difficulties and problems.

When radioactive ion-exchange resin is treated by the method of the invention, the structure of the resin is destroyed and it forms waste material that takes up less space than before. Final storage of the waste can be more easily implemented than before, e.g. by concreting or in other ways, e.g. by placing it in containers.

The patent specifications referred to in the introductory part of the description relate to the treatment of chemical hazardous waste with cold plasma formed by oxygen. However, these specifications are in no way concerned with plasma treatment of radioactive hazardous waste. Moreover, said specifications do not present the advantages achieved when radioactive hazardous waste is treated with cold plasma. Thus, expressly when applied to radioactive waste, plasma treatment provides advantages that cannot be achieved in plasma treatment of other types of waste.

In the following, the invention is described in detail by the aid of embodiment examples.

EXAMPLE 1

A nuclear cower station produces annually 20–40 $m^3$ of radioactive ion-exchange resin, mainly styrene based and acrylic resin, which is used for the removal of partially radioactive impurities and corrosion products from the primary coolant. Final storage of this waste is expensive. Radioactive resins generally cannot be burned because in normal combustion the high temperature causes the release of a lot of active substances into the flue gases. The treatment of the gases generally costs more than the burn-out.

An amount or ion-exchange resin is placed in a container made of quartz or glass. Suction is applied to the container to create a slight negative pressure in it, and oxygen is supplied into the container. Using an antenna and a radio frequency generator, an alternating electric field is applied to the container. The electric field ionizes the oxygen so that a low-temperature plasma is formed. This plasma is very reactive, and it oxidizes the mass into carbon dioxide and water. The gases produced are drawn through a filter into ventilation by means of a vacuum pump. Since the temperature is low, not higher than 150° C., all radioactivity will remain in the cinders thus produced, so the volume of the waste is significantly reduced. Moreover, the cinders produced are chemically suited for concreting or bituminization, both of which are suitable forms for final storage.

EXAMPLE 2

In nuclear power plants, organic cationic and anionic resins are used for the removal of radioactive fission products from the primary circuit cooling water. For example, in a VVER-440 plant the amount of such resin produced in a year may be 15 $m^3$. The resin is extremely radioactive. In the procedure concerned by this patent, this radioactive resin is treated as follows. The used ion-exchange resin obtained from the plant contains water. First, the resin is pre-dried in a low temperature. Next, ten liters of pre-dried resin is placed in a 12-liter cylndrical container made of quartz, which is rotated to achieve continuous mixing. Applying a suction with a vacuum pump, gases are continuously removed from the container so that the negative pressure is about 1 torr. Gaseous oxygen is fed into the same container in such a way that the negative pressure is maintained and the oxygen concentration is as high as possible. Using a suitable antenna, a radio-frequency field with a frequency of e.g. 27.12 MHz and a power or 6 kW is applied to the container. This causes the oxygen in the container to form a plasma, whose temperature may be as low as 60° C. The oxygen plasma is very reactive. Consequently, it oxidizes the organic ion-exchange resin in the container into water and carbon dioxide. These are drawn through a filter into ventilation by the vacuum pump. What remains in the container are the inorganic constituents of the resin, in the first place metals in the form of oxides. These residual cinders contain all the radioactivity. The volume is reduced by a factor of 10–20, depending on the composition of the ion-exchange resin. The cinders and the radioactivity contained in them can be solidified either by glazing, concreting or bituminizing. The solidification product can be safely placed in final storage under ground.

The embodiment examples are intended to illustrate the invention without limiting it in any way.

I claim:

1. A method for the treatment of radioactive hazardous waste, comprising:

supplying the radioactive hazardous waste in a solid form into a container;

supplying oxygen into the container; and applying an alternating electric field to the container so that the oxygen forms a cold plasma, having a temperature in the range of 60° C.–150° C.

2. A method as defined in claim 1, wherein the radioactive hazardous waste is exposed to the cold oxygen plasma in negative pressure conditions.

3. A method as defined in claim 1, wherein the radioactive hazardous waste is low-activity radioactive hazardous waste.

4. A method as defined in claim 1, wherein the radioactive hazardous waste is radioactive ion-exchange resin.

* * * * *